United States Patent [19]

Nagely

[11] 4,358,258

[45] Nov. 9, 1982

[54] HIGH PRESSURE GEAR PUMP OR MOTOR WITH AXIAL RETAINING MEANS AND RADIAL BALANCING MEANS

[75] Inventor: John L. Nagely, Sidney, Ohio

[73] Assignee: Fluid Energy Systems Corporation, Sidney, Ohio

[21] Appl. No.: 291,285

[22] Filed: Aug. 10, 1981

Related U.S. Application Data

[63] Continuation of Ser. No. 55,332, Jul. 6, 1979, abandoned.

[51] Int. Cl.[3] ..... F04C 2/18; F04C 13/00; F04C 15/00; F03C 2/08

[52] U.S. Cl. ..... 418/71; 418/132; 418/134; 418/135

[58] Field of Search ..... 418/71–73, 418/131, 132, 134, 135

[56] References Cited

U.S. PATENT DOCUMENTS

| | | | |
|---|---|---|---|
| 2,714,856 | 8/1955 | Kane | 418/132 |
| 2,772,638 | 12/1956 | Nagely | 418/134 |
| 2,848,953 | 8/1958 | Nagely | 418/134 |
| 2,967,487 | 1/1961 | Nagely | 418/134 |
| 2,974,605 | 3/1961 | Murray | 418/132 |
| 3,029,739 | 4/1962 | Nagely | 418/73 |
| 3,496,877 | 2/1970 | Eckerle et al. | 418/131 |
| 3,558,247 | 1/1971 | Gaertner | 418/131 |

FOREIGN PATENT DOCUMENTS

| | | | |
|---|---|---|---|
| 1006722 | 4/1957 | Fed. Rep. of Germany | 418/73 |
| 840000 | 6/1960 | United Kingdom | 418/132 |
| 934500 | 8/1963 | United Kingdom | 418/135 |

*Primary Examiner*—John J. Vrablik

*Attorney, Agent, or Firm*—Merriam, Marshall & Bicknell

[57] ABSTRACT

A liquid displacement device which utilizes an internal unit assembly type construction wherein the internal unit assembly can be installed in or removed from a cavity in the housing of the device as a unit. The internal unit assembly includes a pair of meshed gears, which are rotatably supported by a pair of axially spaced end plates disposed on opposite sides of the gears. The internal unit assembly also includes at least one pair of thrust members and at least one corresponding pair of axial pressure loading chambers which bias the thrust members in a direction to counterbalance the axial components of the pressure force at the discharge side of housing that tends to separate the end plates from predetermined positions with respect to the side faces of the gears. The internal unit assembly further includes radial pressure balancing chambers which engage the wall of the cavity and which counterbalance the radial components of the pressure force at the discharge side of the housing tending to laterally shift the internal unit assembly toward the inlet side of the housing. At least one tension member holds the components of the internal unit assembly in assembled relation and resists part of the pressure force tending to separate the end plates from their predetermined positions. Retaining rings are releasably mounted in grooves in the wall of the housing cavity for axially locating the internal unit assembly in the housing and for transmitting to the housing other portions of the axial components of the pressure force tending to separate the end plates. Locking rings having tapered inner peripheral surfaces which engage chamfered surfaces on the thrust or end plates of the internal unit assembly also engage the wall of the housing cavity and transmit to the housing portions of the axial components of the pressure force tending to axially separate the end plates from their predetermined positions.

18 Claims, 23 Drawing Figures

FIG. 3
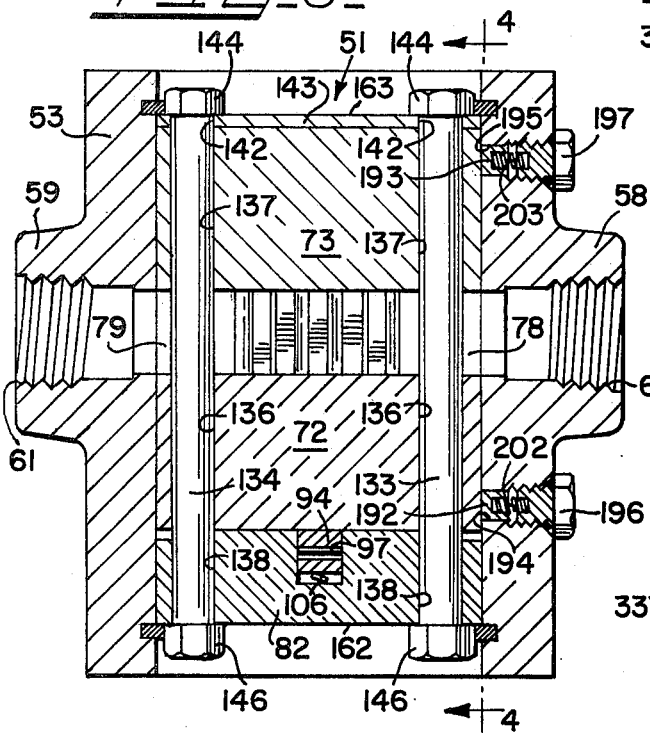
FIG. 14a
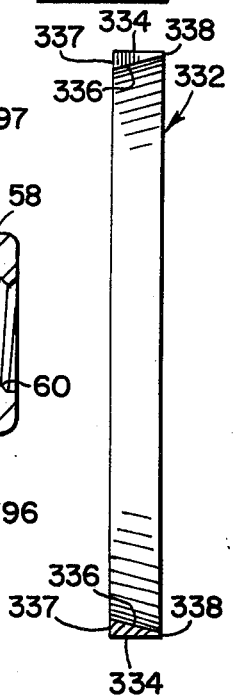
FIG. 14
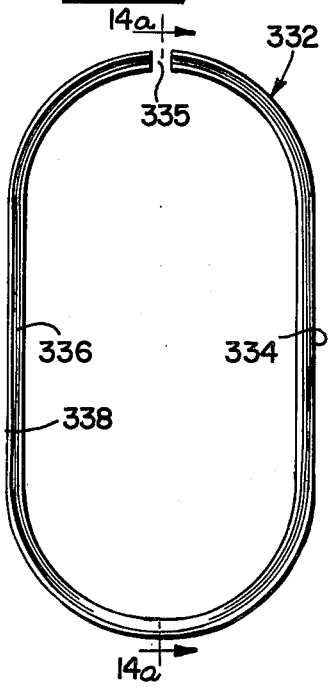
FIG. 4
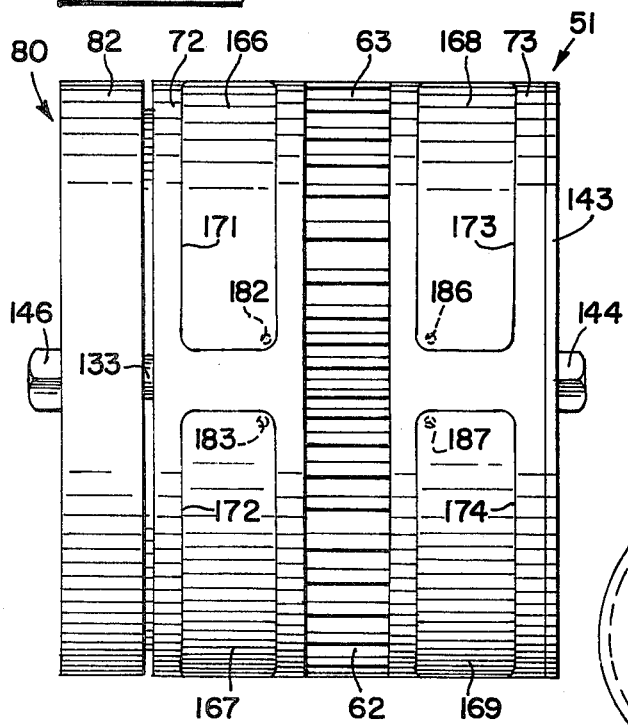
FIG. 8
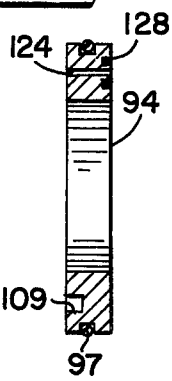
FIG. 6
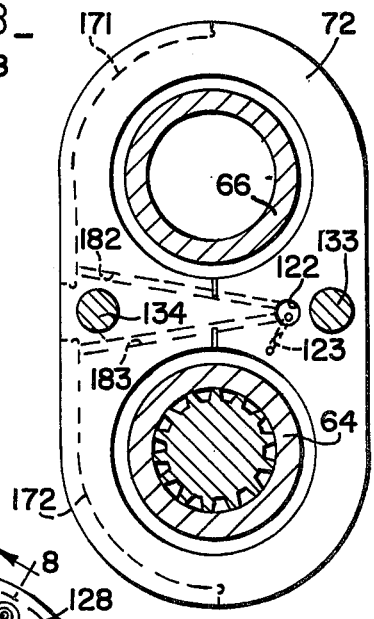
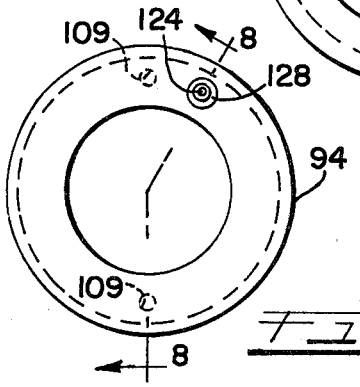
FIG. 7

HIGH PRESSURE GEAR PUMP OR MOTOR WITH AXIAL RETAINING MEANS AND RADIAL BALANCING MEANS

This is a continuation, of application Ser. No. 055,332, filed July 6, 1979, now abandoned.

This invention relates to liquid displacement devices and more particularly relates to high pressure, gear-type hydraulic pumps or motors.

BACKGROUND OF THE INVENTION

One of the problems to be overcome in the design and operation of high pressure, hydraulic gear pumps is that of counterbalancing the axial and radial force components imposed on the meshed gears and their support structures due to the high pressure developed at the discharge side of the pump when the latter is in operation. Such forces tend to shift the gears and their supports toward the low pressure or inlet side of the housing. In addition, the high pressure forces tend to cause the plates or bushings which support the gear shafts to become cocked in the housing with a resulting loss in pumping efficiency, increased power requirements and excessive wear.

One solution to the aforementioned problem is disclosed in my prior U.S. Pat. No. 2,772,638. The gear pump or motor disclosed in this patent utilizes an internal unit assembly construction wherein the liquid displacing elements or gears, and the structure for supporting the gears in meshed, operating relation, are removable as a unit from the housing of the device. The internal unit assembly includes axial pressure loading chambers, which maintain a pumping seal between the side faces of the gears and supporting end plates of the assembly, the reaction forces from the axial pressure loading chambers being taken up by the gear shafts. Because of the fact that the forces which maintain a running seal between the side faces of the gears and the end plates are confined to the components of the internal unit assembly, the housing for the pump is not subjected to large forces and hence does not have to be of a high structural strength. Moreover, the internal unit assembly can be readily removed as a unit for purposes of inspection, repair or replacement, as need be.

In my prior U.S. Pat. No. 3,029,739, an hydraulic pump or motor is disclosed and claimed which likewise utilizes an internal unit assembly type construction. The internal unit assembly disclosed in U.S. Pat. No. 3,029,739 also employs one or more axial pressure loading chambers for maintaining a seal between the side faces of the meshed gears and the end plates which support the same. In addition, one or more radial pressure balancing chambers are defined between the internal unit assembly and housing for counterbalancing the radial force component developed at the discharge side of the internal unit assembly when the pump is in operation so that the internal unit assembly is maintained in a prescribed reference position in the housing. Efficiency is thus maintained throughout the operating speed and pressure ranges of the pump.

BRIEF SUMMARY OF THE INVENTION

Briefly described, the present invention contemplates a liquid displacement device, which is capable of operation at high pressures and which utilizes an internal unit assembly type construction that can be removed as a unit from its enclosing housing for purposes of inspection, repair of replacement. The internal unit assembly is similar to that disclosed in my prior U.S. Pat. Nos. 2,772,638 and 3,029,739 in that it includes a pair of axially shiftable end plates which are disposed at the opposite faces of a pair of meshed gears. The shafts of the gears extend through aligned bores in the end plates and are rotatably journaled therein.

As in my prior U.S. Pat. No. 2,772,638, the internal unit assembly includes thrust means for counterbalancing the force at the discharge side of the pump and tending to separate the end plates from the side faces of the gears. In one embodiment the thrust means comprises a thrust plate disposed on the outer side of one of the end plates and a thrust member mounted in a recess in the face of the thrust plate adjacent to the outer side face of the end plate so that the thrust member engages the end plate. The thrust plate and thrust member define at least one axial pressure loading chamber therebetween. A tension member extends through the end plates and thrust plate and serves to take up a portion of the force transmitted to the thrust plate from the axial pressure loading chamber.

In another embodiment, a pair of thrust plates are provided on opposite sides of the end plates, and thrust members are mounted in recesses in the thrust plates so that axial pressure loading chambers are defined at each end of the internal unit assembly.

In still another embodiment, the axial pressure loading chambers are provided in two thrust members defined by two pair of axially spaced plate members, which are in the shape of a figure "8" and which are disposed between the side faces of the meshed gears and the end plates.

In all of the embodiments, to be hereinafter described in detail, coil springs, or their equivalent, engage the thrust members and establish a minimum static, axial clearance between and accommodate thermal expansion of the parts of the internal unit assembly. In addition, releasable retaining means is provided for axially locating the internal unit assembly in a cavity in its supporting housing and for transmitting a portion of the axial component of the force from the high pressure zone of the pump, which tends to separate the end plates from the side faces of the gears, to the central section of the housing.

In certain embodiments, split locking rings are mounted in the housing cavity for frictionally engaging the wall of the cavity and chamfered surfaces on either the thrust plates or end plates of the internal unit assembly, the locking rings serving to lock the thrust plates or end plates of the internal unit assembly in the cavity and to transmit another portion of the axial component of the force from the high pressure zone of the pump, which tends to separate the plates from the side faces of the gears, to the central section of the housing. Consequently, a minimum number of tension members is required to maintain the integrity of the internal unit assembly during high pressure operation and only the central portion of the housing needs to be of high structural strength. Thus, the end covers of each pump can be of reduced wall thickness.

As in my prior U.S. Pat. No. 3,029,739, certain of the embodiments of the fluid displacement device herein disclosed include radial pressure balancing chambers disposed between the internal unit assembly and a wall of the cavity or bore in the pump housing and arranged at the low pressure side of the pump so that the internal unit assembly remains substantially centralized in its bore throughout the operating pressure range of the pump.

In addition, in certain of the embodiments, one or more spring-pressed plungers are mounted in the housing so that the plungers engage the end plates of the internal unit assembly and bias the lateral side faces of the end plates into a minimum or zero radial, static clearance relation with the bore in the pump housing so that pumping efficiency is immediately established at starting and prior to the time that pressure has built up in the radial pressure balancing chambers.

DESCRIPTION OF THE VIEWS OF THE DRAWINGS

FIG. 3 is a horizontal sectional view, with some parts in elevation, taken substantially along the line 3—3 of FIG. 2;

FIG. 4 is a side elevational view, with portions omitted for clarity of presentation and taken substantially along the line 4—4 of FIG. 3, of the internal unit assembly portion of the liquid displacement device illustrated in FIG. 1;

FIGS. 5 and 6 are vertical sectional views taken along the lines 5—5 and 6—6 of FIG. 1;

FIG. 7 is a front elevational view of the annular thrust member employed in the liquid displacement device illustrated in FIG. 1 and taken substantially along the line 7—7 of FIG. 1;

FIG. 8 is a sectional view taken along the line 8—8 of FIG. 7;

FIG. 14 is an end elevational view, taken substantially along the line 14—14 of FIG. 9, of one of the tapered rings utilized in the liquid displacement device illustrated in FIG. 9;

Figure 15:
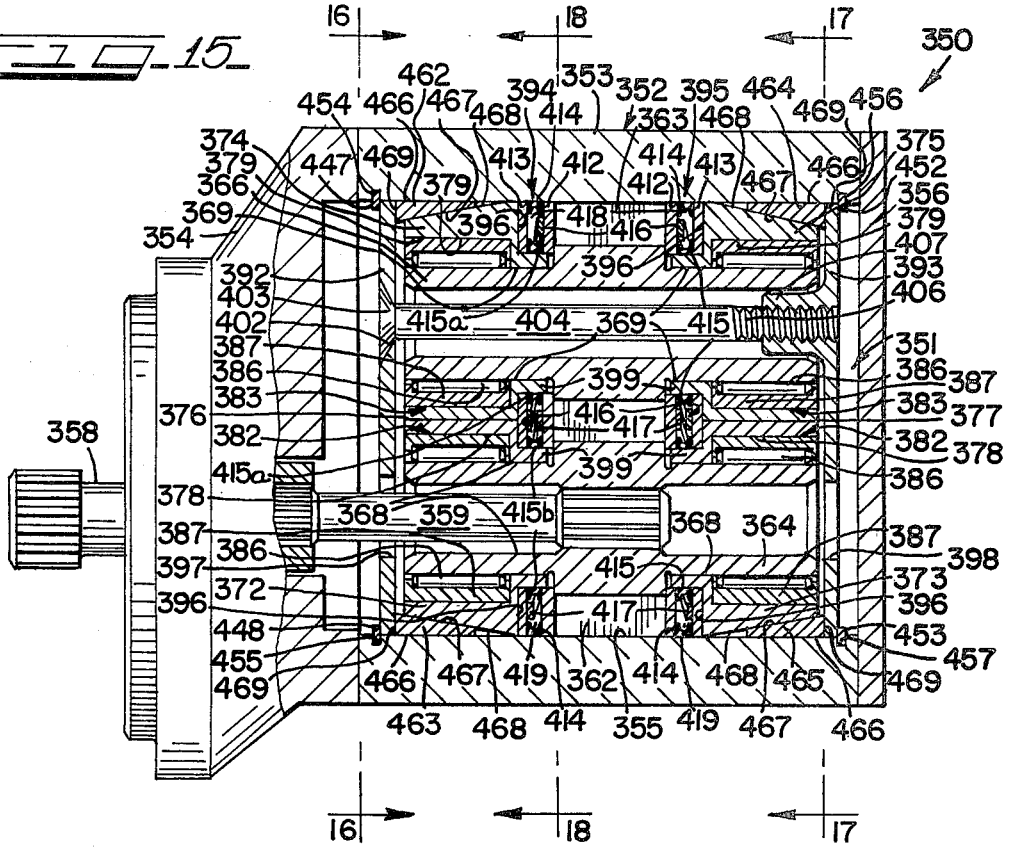
Figure 16:
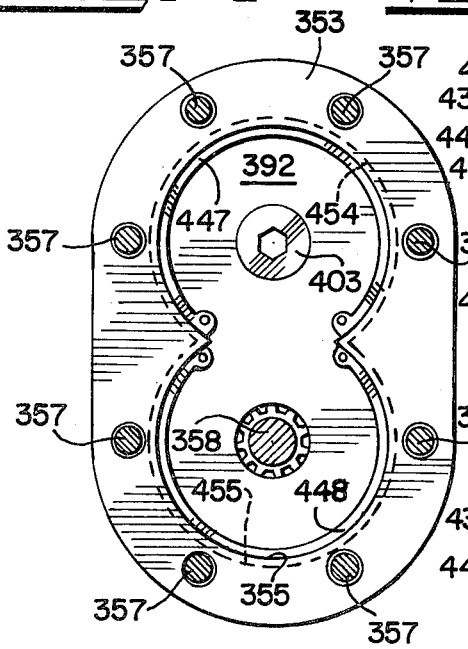
Figure 20:
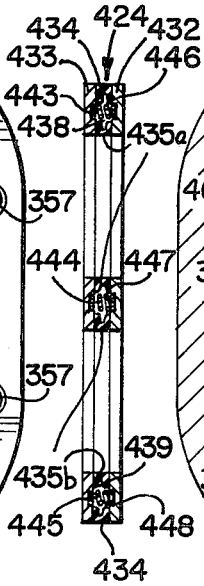
Figure 17:
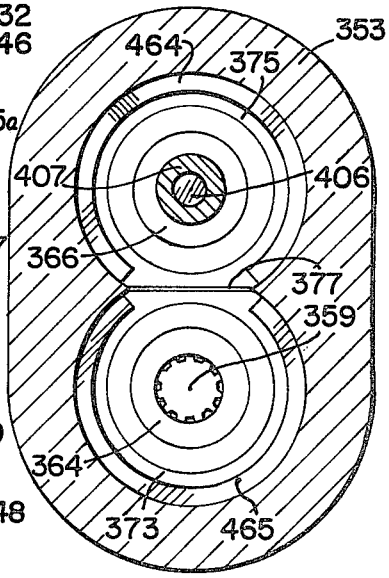
Figures 18, 19, 20, 21, 22:
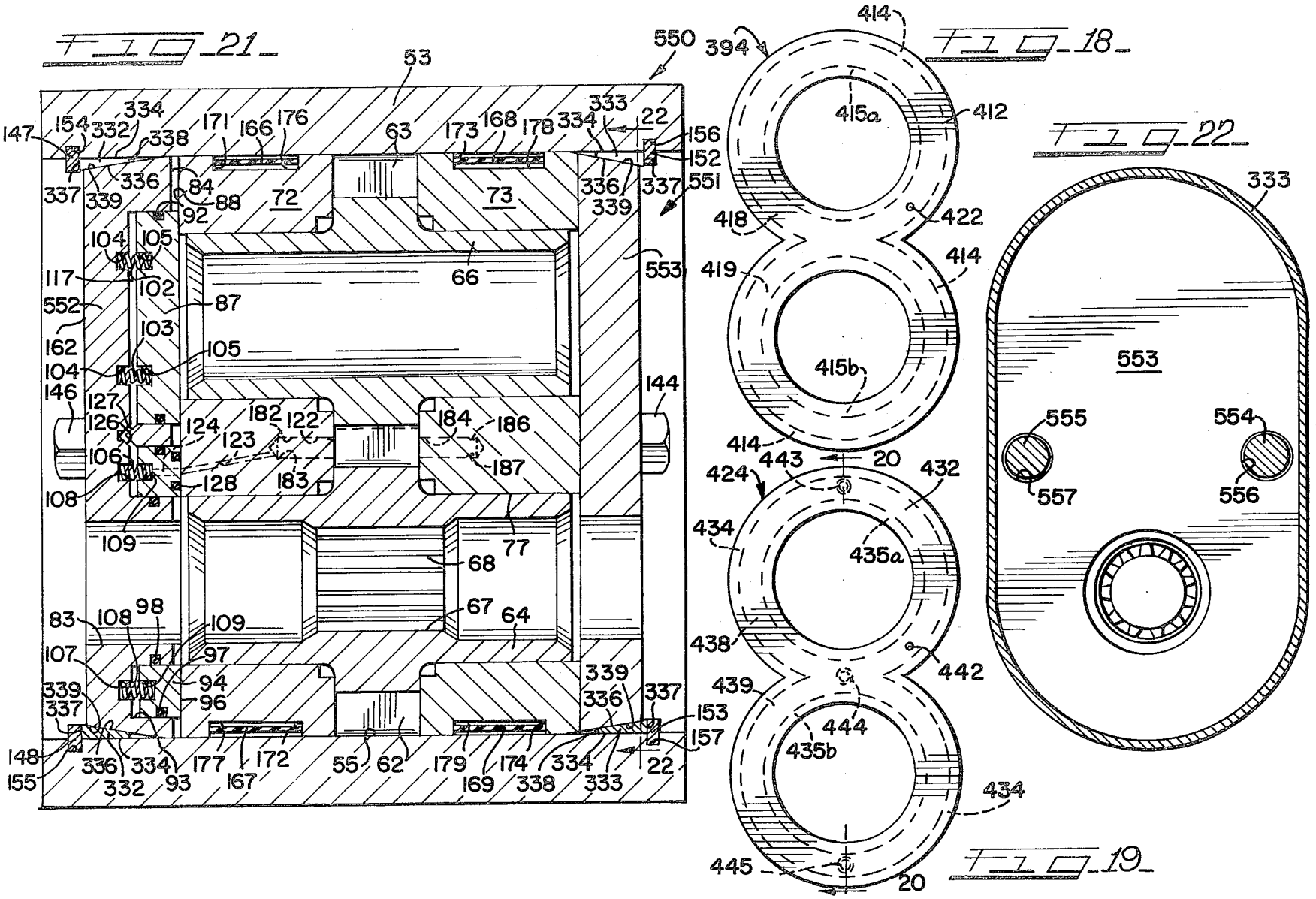

FIG. **14*a* is a sectional view taken along the line 14*a*—14*a* of FIG. 14**;

FIG. 15 is a longitudinal sectional view, with portions thereof in elevation, of another liquid displacement device embodying the features of the present invention;

FIGS. 16, 17 and 18 are a series of vertical sectional views taken along the lines 16—16, 17—17 and 18—18, respectively of FIG. 15;

FIG. 19 is a front elevational view, similar to FIG. 18, of a portion of the internal unit assembly illustrated in FIG. 15;

FIG. 20 is a vertical sectional view taken along the line 20—20 of FIG. 19;

FIG. 21 is an enlarged longitudinal sectional view of the central portion of another liquid displacement device embodying the features of the present invention; and FIG. 22 is a sectional view taken along the line 22—22 of FIG. 21.

DESCRIPTION OF THE EMBODIMENT ILLUSTRATED IN FIGS. 1-8

Referring now to FIGS. 1-8 of the drawings, a gear-type liquid displacement device or pump comprising a preferred embodiment of the invention is illustrated and indicated generally at 50. The pump 50 comprises an internal unit assembly, indicated generally at 51, which is mounted in and enclosed by a housing 52 which includes a central section 53 and drive and anti-drive covers or end sections 54 and 56, respectively. Specifically, the internal unit assembly 51 is mounted in a cavity or bore 55 in the central section 53. The covers or end sections 54 and 56 are secured to the central section 53 by threaded fasteners (not shown). The drive cover or end section 54 rotatably supports a drive shaft 57 which extends into the internal unit assembly 51 and serves to effect rotation of the pumping components of the internal unit assembly. A pair of bosses 58 and 59 (FIGS. 2 and 3) are formed on the opposite sides of the central section 53, the bosses 58 and 59 respectively having threaded bores 60 and 61 therethrough comprising inlet and outlet ports in the housing 52. The various seals and gaskets between the housing sections 53, 54 and 56 and around the drive shaft 57 in the end section 54, have been omitted for simplicity of illustration.

Figure 1:
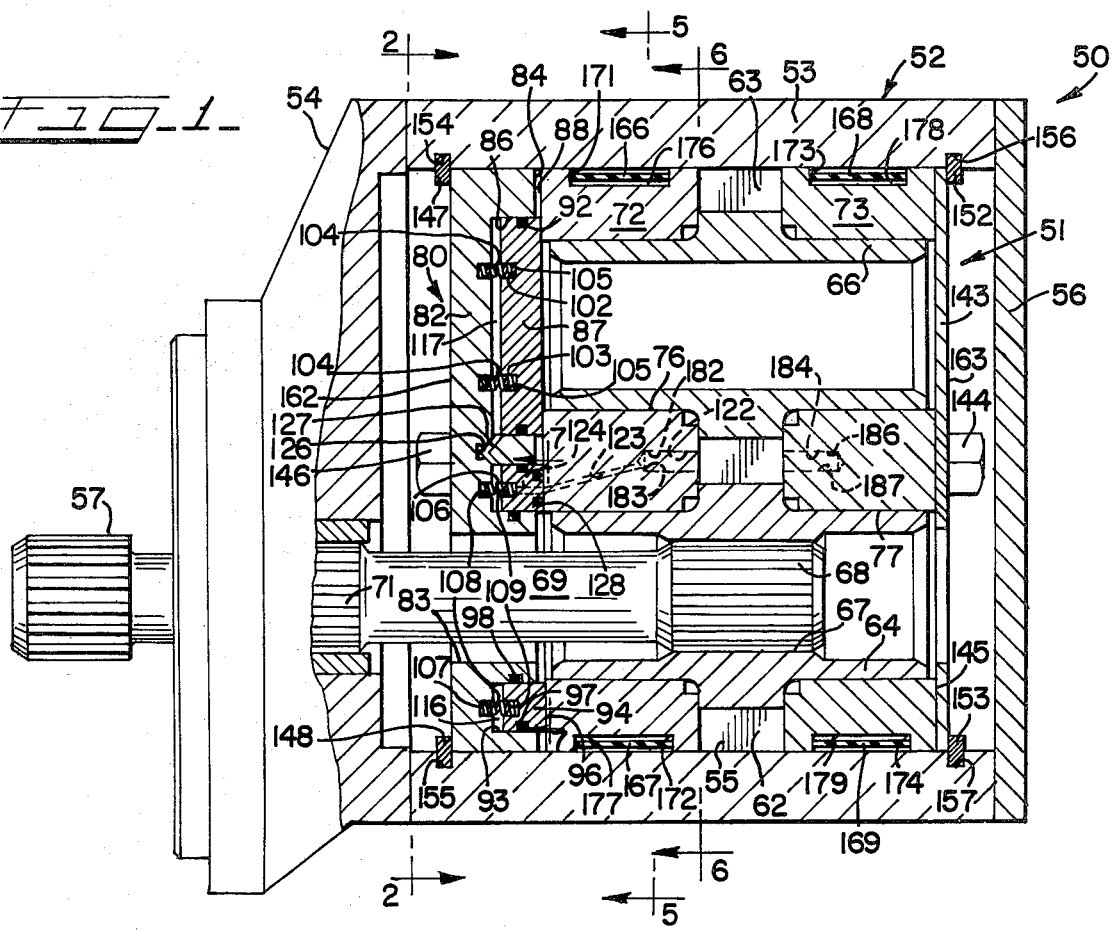
FIG. 1 is a longitudinal sectional view, with some parts in elevation, of a liquid displacement device embodying the features of the present invention.

Referring now to FIGS. 3, 4, 5 and 6 in conjunction with FIG. 1, the internal unit assembly generally comprises a pair of liquid displacing elements or gears 62 and 63 having integral, hollow shafts 64 and 66, respectively. The shaft 64 is internally splined as at 67 so as to mesh with splines 68 on the inner end of an extension 69 connected to the drive shaft 57. The gears 62 and 63 are rotatably supported in meshed relation by support members in the form of a pair of spaced end plates 72 and 73 disposed at the opposite side faces of the meshed gears and having bores 76 and 77 therethrough constituting bearings for the gear shafts 64 and 66.

Figure 2:
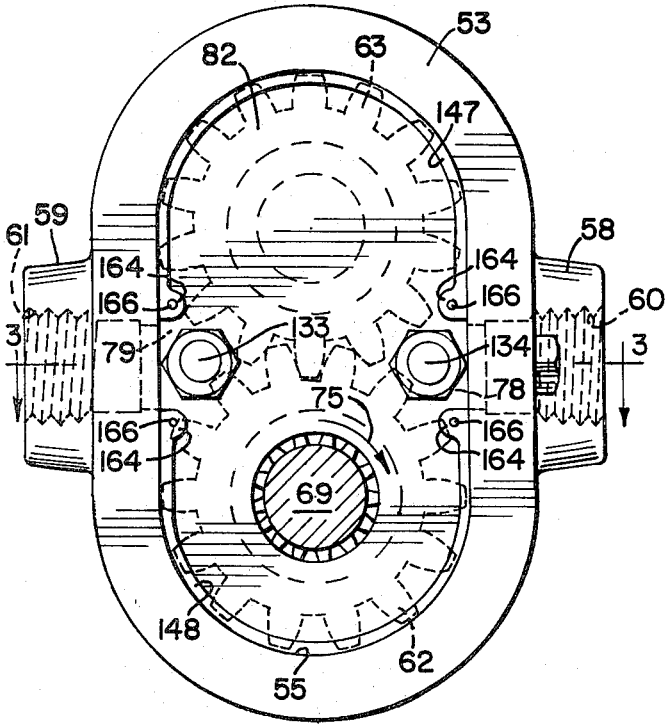
FIG. 2 is a vertical sectional view taken substantially along the line 2—2 of FIG. 1.

When the gear 62 is driven in the direction of the arrow 75 shown in FIG. 2, and the port 60 is connected to a source of liquid to be pumped, a zone of low pressure, indicated at 78, is generated in the housing 52 between the end plates 72 and 73 and in the area where the gear teeth are moving out of mesh, which results in suction at the inlet port 60. At the same time, a zone of high pressure, indicated at 79, is generated in the housing 52 between the end plates 72 and 73, and in the area where the gear teeth begin to move into mesh, which results in expulsion of fluid through the outlet port 61.

According to the present invention, thrust means is provided for counterbalancing the axial components of the pressure force developed at the discharge zone of the pump which tend to separate the end plates 72 and 73 from the side faces of the gears 62 and 63. Such thrust means is indicated generally at 80 and comprises a plate 82 (FIGS. 1-4, inclusive), having the same general configuration in plan as the end plates 72 and 73. A bore 83 in the lower portion of the plate 82, as viewed in FIG. 1, accommodates the shaft extension 69.

The inner side, indicated at 84, of the plate 82 is formed with a recess 86 which, in the present instance, is circular. A thrust member, in the form of a circular plate or piston 87, closely fits and is shiftably mounted in the recess 86. The diameter of the plate 87 is somewhat greater than the diameter of the bore 76 in the plate 72 so that a portion of the plate 87 overlaps the bore 76 and engages a portion of the outer side, indicated at 88, of the end plate. An O-ring 92 is seated in a groove in the peripheral edge of the recess 86 to prevent leakage between the periphery of the plate 87 and the wall of the recess 86.

Another recess 93 is provided in the inner side 84 of the thrust plate 82, the recess 93 being annular and surrounding the bore 83. An annular thrust member or piston 94 (FIGS. 1, 7 and 8), closely fits and is shiftably mounted in the annular recess 93, the axial centers of the recess 93 and thrust member 94 being coincident with the axis of the bore 83, which is coaxial with the bore 77 and axis of rotation of the shaft 69. The inside and outside diameters of the thrust member 94 are such that the inner end face, indicated at 96, of the thrust member 94 engages a portion of the outer side 88 of the end plate 72 around the margin of the shaft bore 77. An O-ring 97 is seated in an annular groove in the radially outer edge of the thrust member 94 and an O-ring 98 is seated in another groove in the radially inner side wall of the annular recess 93. The O-rings 97 and 98 prevent leakage between the radially inner and outer edges of the piston or thrust member 94 and the radially inner and outer peripheral walls of the annular recess 93.

In order to provide a minimum static, axial clearance between the side faces of the gears 62 and 63 and end plates 72 and 73 of the internal unit assembly 51, spring means is provided for biasing the thrust members 87 and 94 out of their recesses 86 and 93 and into engagement with the outer side face 88 of the end plate 72. Such spring means comprises at least one and preferably a pair of coil springs 102 and 103 seated in two pairs of aligned bores 104, 105 in the opposed surfaces of the bottom of the recess 86 and thrust plate member 87, respectively. The spring means also includes at least one and preferably another pair of coil springs 106 and 107 seated in two axially extending, aligned pairs of bores 108 and 109 in the opposed surfaces of the annular recess 93 and thrust plate member 94. The pairs of springs 102, 103 and 106, 107 are symmetrically arranged with respect to the axes of their respective gears 63 and 62. The pairs of springs 102, 103 and 106, 107 also serve to accommodate thermal expansion of the operating parts of the internal unit assembly 51.

When mounted in the recesses 86 and 93, the thrust plate member 87 and annular thrust member 94 define a pair of axial pressure loading chambers 116 and 117 therebetween, which are connected by passage means to the high pressure zone 79 of the device 50. Consequently, a desired minimum clearance and a capillary seal will be maintained between the side faces of the gears 62 and 63 and the opposing side faces of the end plates 72 and 73 throughout the operating ranges of speeds and pressures of the pump since the pressure in the chambers 116 and 117 will vary directly with the output pressure in the high pressure zone 79.

Fluid under pressure from the high pressure zone 79 is communicated to the axial pressure loading chambers 116 and 117 through a series of connected bores in the end plate 72 and annular thrust plate member 94, as will now be described. Thus, pressure in the high pressure zone 79 is initially communicated through an axial bore 122 (FIGS. 1, 5 and 6) in the end plate 72 to the inner end of a diagonally extending passage 123 (FIGS. 1 and 6) in the end plate 72. The opposite end of the diagonal bore 123 opens in the end face 88 of the end plate 72. The outer end of the bore 123 communicates with the inner end of an axially extending bore 124 in the annular thrust plate member 94 and the inner end of the bore 124 communicates with the bottom of the spring bore 109. The connected bores 122, 123 and 124 and spring bore 109 thus comprise passage means connecting the discharge pressure zone 79 of the device 50 with the annular, axial pressure loading chamber 116.

Pressure in the pressure loading chamber 116 is communicated to the circular, axial pressure loading chamber 117 through a pair of diagonally extending, intersecting bores 126 and 127 (FIG. 1) in the thrust plate 82. An O-ring 128, seated in an annular groove in the end face of the annular thrust member 94, prevents leakage and a pressure loss across the interface between the thrust plate member 94 and end plate 72 in the vicinity of the connected bores 123 and 124.

The components of the internal unit assembly 51 are maintained in assembled relation by at least one and preferably a pair of tension members in the form of a pair of high tensile strength steel bolts 133 and 134 which extend through aligned bores 136 and 137 in the end plates 72 and 73, aligned bores 137 in the thrust plate 82, and through aligned bores 142 in a thrust plate 143 of the same shape as the thrust plate 82 and disposed at the opposite end of the internal unit assembly 51 from the plate 82. The heads, indicated at 144 of the bolts 133 and 134, in the present instance, engage the thrust plate 143 and hold the plate engaged with the outer side, indicated at 145, of the end plate 73. The nuts 146 are threaded onto the opposite ends of the bolts 133 and 134 and engage the outer surface of the thrust plate 82.

In order to axially locate the internal unit assembly 51 in the cavity in the central section 53 of the housing 52 so that the gears 62 and 63 are in radial alignment with the inlet and outlet ports 60 and 61, releasable retaining means is provided. Such releasable retaining means also coacts with the thrust means 80 to transmit stresses in excess of those resisted by elongation of the tension members 133 and 134 to the central section 53 of the housing 51. The retaining means thus comprises two pairs of generally U-shaped retaining rings 147, 148 and 152, 153, respectively seated in circumferentially extending grooves 154, 155 and 156, 157 in the wall of the cavity of the central housing section 53. The distance between the pairs of grooves 154, 155 and 156, 157 is such that the outer face, indicated at 162, of the thrust plate 82 and the outer face, indicated at 163, of the thrust plate 143 will engage the axially inner faces of their respective pairs of retaining rings 147, 148 and 152, 153 and transmit stress to the rings 147, 148, 152 and 153 when the stress in the bolts 133 and 134 exceeds a predetermined value. Stresses transmitted to the retaining rings 147, 148, 152 and 153 are transmitted to and resisted by the central section 53 of the housing 52, as will be described more fully in the operational summary of the device 50.

As best seen in FIG. 2, the retaining rings 147, 148 and 152, 153 have the same configuration as the internal contour of the housing section 53 so that the entire length of the ring is seated in its mounting groove. In addition, the ends, indicated at 164, of each ring are enlarged and provided with recesses or holes 166 therethrough into which the movable ends of an appropriate tool may be inserted for mounting and demounting the rings. The rings 147, 148, 152 and 153 are preferably of high strength, spring steel, but other suitable materials could also be used.

In addition to the axial components of the force generated by high pressure in the zone 79, which tends to separate the end plates 72 and 73 from the side faces of the gears 62 and 63, high pressure in the zone 79 also results in a radial force component which tends to cause the internal unit assembly 51 to shift toward the inlet port 60 when the device is in operation. In order to counterbalance this radial force component, the device 50 includes radial pressure balancing means, similar to that disclosed in my prior patent No. 3,029,739, for this purpose. Such radial pressure balancing means includes means defining at least one and preferably a plurality of expansible chambers on the internal unit assembly 51 that are adapted to be connected to a source of fluid under pressure which varies as a function of the discharge pressure of the device 50. According to the present invention, the preferred source of this fluid pressure is the high pressure zone 79 of the device 50.

Figure 5:
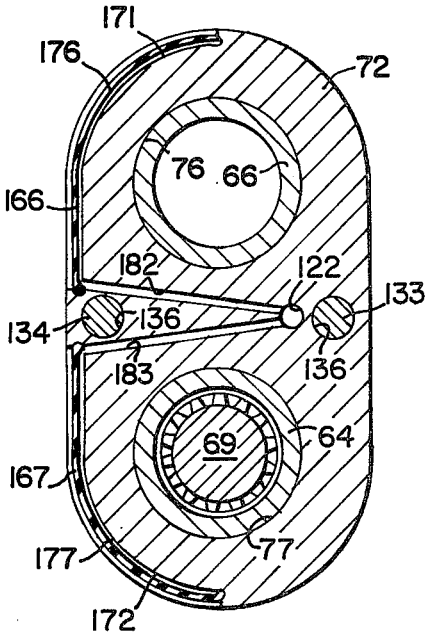

As best seen in FIGS. 4 and 5, the aforementioned means defining the radial pressure balancing chambers comprises two pairs of generally rectangular, resilient members or "boots" 166, 167 and 168, 169, which are mounted in similarly-shaped recesses 171, 172, 173 and 174 in the sides of the end plates 72 and 73 adjacent to the inlet port 60. The marginal edges of the resilient members 166, 167, 168 and 169 are bonded or otherwise suitably fastened to the edges of the recesses 171, 172, 173 and 174 in pressure-sealed relation. When secured in their respective recesses, the resilient members 166, 167, 168 and 169 define four chambers 176, 177, 178 and 179, respectively, which are connected to the high pressure zone 79 of the device 50 by fluid passage means, now to be described.

The fluid passage means for conducting high pressure to the radial pressure balancing chambers 176 and 177 comprises at least one and preferably a pair of generally transversely extending bores 182 and 183 in the end plate 72. One end of each of the bores 182 and 183 is connected to the axial bore 122 and the opposite ends of the bores 182 and 183 are respectively connected to the radial pressure balancing chambers 176 and 177.

In order to communicate pressure from the zone 79 to the radial pressure balancing chambers 178 and 179, an axial bore 184 (FIG. 1) is provided in the end plate 73, the bore 184 extending outwardly from the inner side face of the end plate 73 toward the thrust plate 143 to a depth substantially equal to the depth of the bore 122. The axis of the bore 184 is coincident with that of the bore 122 and the inner ends of a pair of generally transversely extending passages 186 and 187 intersect the outer end of the bore 184 in the manner of the passages 182 and 183. The outer ends of the passages 186 and 187 register with the radial pressure balancing chambers 178 and 179 in the approximate positions indicated in FIG. 4.

As pressure in the zone 79 increases with rotation of the gears 62 and 63, such pressure is communicated through the axial bores 122 and 184 to the transversely extending passages 182, 183 and 186 and 187 and thence to the radial pressure balancing chambers 176 and 177 and 178 and 179. The resilient boots 166, 167 and 168, 169 are thus caused to expand against the adjacent wall of the housing section 53 and provide a radial force tending to laterally shift the internal unit assembly 51 in the cavity 55 toward the high pressure zone 79. The magnitude of the force tending to shift the internal unit assembly 51 toward the high pressure zone 79 will vary directly with the pressure in the zone 79 so that a zero or only a capillary clearance will be present between the lateral side faces of the end plates 72 and 73 and the wall of the cavity 55 in the housing section 53.

According to the present invention, the liquid displacement device 50 includes means for establishing the aforementioned zero radial or capillary clearance between the lateral side faces of the end plates 72 and 73 and between the lateral side edges of the thrust plates 82 and 143 and the bore 55 of the housing section 53 on starting of the device 50 and prior to the time that pressures has built up in the radial pressure balancing chambers 176, 177, 178 and 179. Such means preferably comprises at least one and preferably a pair of plungers 192 and 193 (FIG. 3), which are shiftably mounted in a pair of bores 194 and 195 in the housing section 53. The bores 194 and 195 extend transversely to the axis of the cavity 55 and are disposed on opposite sides of the inlet boss 58 so that the plungers 192 and 193 respectively engage the end plates 72 and 73. The bores 194 and 195 lie in the plane of the bolts 133 and 134 and the axis of the inlet and outlet ports 60 and 61.

The outer end of the bores 194 and 195 are threaded to receive screws 196 and 197. The screws 196 and 197 provide abutments for the outer ends of a pair of compression coil springs 202 and 203. The inner ends of the springs 202 and 203 engage the plungers 192 and 193 and bias the internal unit assembly 51 toward the discharge port 61 to establish the aforementioned zero, radial static clearance between the lateral side faces of the end plates 72 and 73 and between the side edges of the thrust plates 82 and 143 with the bore 55 in the housing section 53.

Assembly and Operation of the Fluid Displacement Device 5C

The components of the internal unit assembly 51 are assembled by engaging the shafts 64 and 66 in their respective bores 77 and 76 in the end plates 72 and 73 while the teeth of the gears 62 and 63 are in mesh. Thereafter, the thrust plate 82 having the circular thrust member 87 and annular thrust member 94 mounted in their complementally-shaped recesses 86 and 93, is positioned so that the thrust members 87 and 94 engage the outer side face 88 of the end plate 72. The thrust plate 143 is also positioned adjacent the outer side face 145 of the end plate 73. Thereafter, the bolts or tension members 133 and 134 are inserted through their respective bores 136 and 137 in the end plates 72 and 73, and through the bores 138 and 142 in the thrust plates 82 and 143. The nuts 146 are then threaded onto the ends of the bolts 133 and 134 and drawn up so that a substantially zero static clearance is obtained between the side faces of the gears 62 and 63 and the adjacent inner end faces of the end plates 72 and 73. The springs 102, 103, 106 and 107 also help to maintain the aforementioned substantially zero clearance between the side faces of the gears 62 and 63 and end plates 72 and 73 when the device 50 is inoperative. In addition, the nuts 146 are drawn up so that a predetermined clearance is established between the inner faces of the retaining rings 147, 148 and 152, 153 and the outer end faces 162 and 163 of the thrust plates 82 and 143 when the internal unit assembly 51 is mounted in the cavity 55 of the central housing section 53.

After the internal unit assembly 51 has been assembled as previously described, the assembly 51 is installed in the cavity 55 of the central section 53 of the housing 52 by shifting the internal unit assembly into the housing section through either end thereof.

Prior to inserting the internal unit assembly 51 in the cavity 55, the screws 196 and 197 are unthreaded from their bores 194 and 195 a sufficient distance to relieve the compression in the springs 202 and 203 and the plungers 192 and 193 are retracted in their bores to permit the end plates 72 and 73 and gears 62 and 63 to slide past the plungers 192 and 193. The screws 196 and 197 are then threaded into the bores to compress the springs 202 and 203 and apply a force on the internal unit assembly 51 biasing the latter toward the outlet port 61 of the housing section 53 so as to establish the above-mentioned zero, radial, static clearance between the internal unit assembly and the side wall of the cavity 55 in the central housing section 53.

Assuming that the internal unit assembly 51 has been shifted into its proper position in the cavity in the housing section 53 i.e. so that the gears 62 and 63 are in general transverse alignment with the inlet and outlet ports 60 and 61, respectively, the internal unit assembly is secured in this position in the bore by installing the retaining rings 147, 148 and 152, 153 in their respective grooves 154, 155 and 156, 157. This is done by engaging a proper tool with the openings 166 in the ends 164 (FIG. 2) of the retaining rings and permitting the rings to expand into their grooves, as shown in FIGS. 1 and 3.

After the internal unit assembly 51 is secure in the housing section 53, the splines 68 on the inner end of the drive shaft extension 69 are engaged with the splines 67 of the gear shaft 64. The splines, indicated at 71, on the outer end of the shaft extension 69 are then engaged with the internal splines on the inner end of the drive shaft 57 as the drive section 54 of the housing 52 is secured to the end of the central section 53. The end section 56 of the housing 52 is then secured to the opposite end of the central section 53 and the pump 50 is ready for operation.

Assuming that fittings (not shown) on the ends of inlet and outlet pipes (also not shown) are threaded into the inlet and outlet ports 60 and 61, respectively, and that a suitable source of power is connected to the drive shaft 57 to cause rotation of the gear 62 in the direction of the arrow 75 shown in FIG. 2, suction will immediately develop in the zone 78 and pressure will immediately begin to rise in the zone 79 upon rotation of the drive shaft 57. The zero or capillary clearance between the lateral sides of the end plates 72 and 73 and the bore 55 of the housing section 53 adjacent the discharge port 61 assures this result.

When the device 50 is operating at rated speed and pressure, a near zero or capillary clearance is maintained between the side faces of the gears 62 and 63 and end plates 72 and 73 due to the pressure in the axial pressure loading chambers 116 and 117, such pressure being communicated to the chambers 116 and 117 through the axial bore 122, diagonal bore 123 and intersecting diagonal bores 126 and 127 in the thrust plate 82.

A substantially zero clearance condition is also maintained between the lateral side faces of the end plates 72 and 73 and the cavity 55 of the housing section 53 when the pump 50 is in operation due to pressure in the radial pressure balancing chambers 176, 177 and 178, 179. Thus, pressure from the high pressure zone 79 of the device 50 is communicated to the radial pressure balancing chambers 176 and 177 through the transversely extending passages 182 and 183 and pressure from the high pressure zone 79 is communicated to the radial pressure balancing chambers 178 and 179 through the transversely extending passages 186 and 187. The passages 182, 183 and 186, 187 respectively communicate with the axial bores 122 and 184 and the latter communicate with the high pressure zone 79 of the device 50. Since the pressure in the radial pressure balancing chambers 176, 177 and 178, 179 varies directly with the pressure in the high pressure zone 79, the desired substantially zero or capillary clearance relationship between the end plates 72, 73 and the cavity in the housing section 53 is maintained throughout the full operating speed and pressure range of the device 50.

As the pressure in the high pressure zone 79 increases, the force tending to separate the end plates 72 and 73 from the side faces of the gears 62 and 63 likewise increases and causes elongation of the bolts 133 and 134. Assuming that the working outut pressure of the device 50 is approximately 3000 psi, the force tending to separate the end plates 72 and 73 from the side faces of the gears 62 and 63 might exceed the elastic limits of the bolts 133 and 134. To avoid this, the axial clearance between the thrust plates 82 and 143 and the retaining rings 147, 148, 152 and 153, is such that the thrust plates contact the retaining rings before the tensile stress in the bolts 133 and 134 exceeds the elastic limits of the bolts. Thus, the retaining rings 147, 148, 152 and 153 provide an additional force resisting separation of the end plates 72 and 73 from the side faces of the gears 62 and 63. The force applied to the retaining rings 147, 148, 152 and 153 from the thrust plates 82 and 143 is, of course, ultimately resisted by the material of the housing section 53. Because of the aforementioned force distribution arrangement, the liquid displacement device 50 can safely operate at much higher pressures than would be possible if only the tensile strength of the bolts 133 and 134 were relied upon to resist the axial forces tending to separate the end plates 72 and 73 from the side faces of the gears 62 and 63.

If the stress in the bolts 133 and 134 is sufficient to cause a significant reduction in the cross sectional area of the bolts when the pump 50 is operating at or near its design output pressure, O-ring seals can be provided in circumferential grooves in the bolts for engaging the bores 136 and 137 in the end plates 72 and 73 and preventing leakage and pressure loss in the clearance space between the bolts 133 and 134 and their bores 136 and 137.

By way of example, if the diameter of the bolts 133 and 134 is approximately $\frac{3}{8}$ of one inch, and if the effective axial area of the end plates and gears is such that, at an output pressure of approximately 3000 psi, the tensile stress developed in each bolt would be in the order of 162,000 psi. Such stress might exceed the elastic limits of the bolts. However, by having the retaining rings take up some of this stress, the elastic limits of the bolts are not exceeded. If approximately 11,000 lbs. of the force tending to separate the end plates 72 and 73 from the side faces of the gears 62 and 63 is taken up by the retaining rings 147, 148, 152 and 153, the sheer stress imposed on the retaining rings is in the order of 62,400 psi. Such stress is within the acceptable limits of the retaining rings. Consequently, approximately 62% of the reaction force resisting separation of the end plates 72 and 73 from the side faces of the gears 62 and 63 is resisted by the retaining rings 147, 148, 152 and 153, and approximately 38% of this force is resisted by the bolts 133 and 134.

Description of the Embodiment Illustrated in FIGS. 9–14*a*, Inclusive

In FIGS. 9–14*a*, inclusive, another gear-type liquid displacement device or pump comprising another embodiment of the invention, is illustrated and indicated generally at 250. The device 250 is similar to the device 50. Consequently, like reference numerals have been used to identify identical parts.

Figures 9, 10, 11, 12, 13:
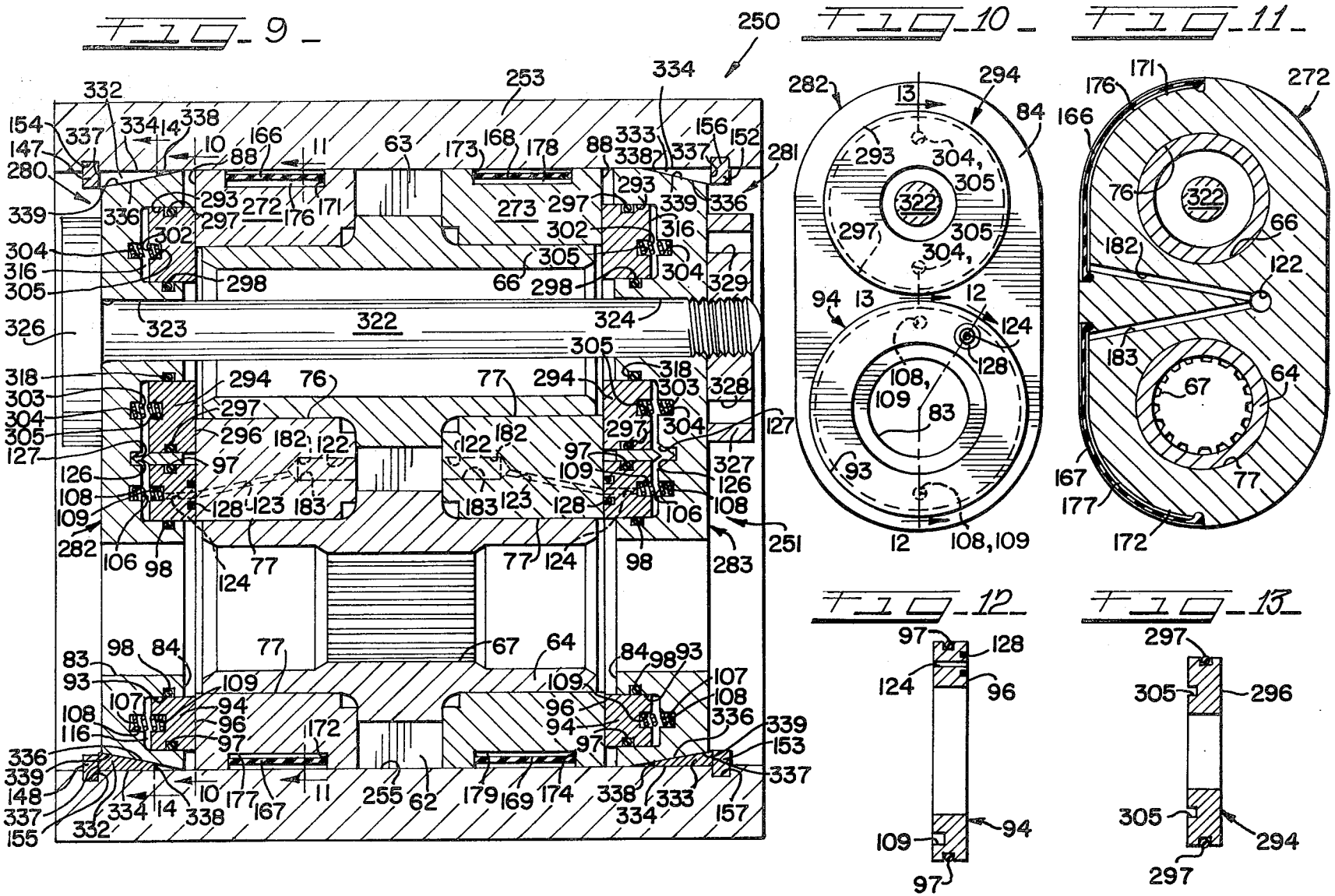
FIG. 9 is an enlarged longitudinal sectional view of the central portion of another liquid displacement device embodying the features of the present invention.
FIGS. 10 and 11 are vertical sectional views taken along the lines 10—10 and 11—11 of FIG. 9.
FIG. 12 is a sectional view taken along the line 12—12 of FIG. 10.
FIG. 13 is a sectional view, with some parts omitted for clarity of presentation, taken along the line 13—13 of FIG. 10.

As will be apparent from FIG. 9, which is drawn on a larger scale than the device 50 for clarity, the device 250 comprises an internal unit assembly, indicated generally at 251, which is mounted in and enclosed by a housing. The housing includes a central section 253 and drive and anti-drive covers or end sections (not shown), which are similar to the covers or end sections 54 and 56 of the device 50 and which are secured to the central section 253 by threaded fasteners (also not shown). One of the covers rotatably supports a drive shaft which extends into and effects rotation of the pumping components of the internal unit assembly 251.

The internal unit assembly 251 is mounted in a cavity or bore 255 in the central section 253 and bosses (not shown) on the laterally opposite sides of the section 253 and having threaded bores or ports therethrough (also not shown) are provided on the housing section 253.

Referring now to FIGS. 10 and 11 in conjunction with FIG. 9, the internal unit assembly 251 includes a pair of liquid displacing elements or gears 62 and 63 having integral, hollow shafts 64 and 66, respectively. The shafts 64 and 66 are rotatably supported in bores 76 and 77 in a pair of end plates 272 and 273 disposed on opposite side faces of the gears 62 and 63. Since the gears 62 and 63 of the internal unit assembly 251 are of the same construction and driven in the same manner as the gears 62 and 63 of the internal unit assembly 51, further description of these parts will not be included. Moreover since the drive end section for the housing 253 and its related drive structure have been omitted from FIG. 9, the drive shaft extension has likewise been omitted from FIG. 9.

According to the present invention, the internal unit assembly 251 includes thrust means, indicated generally at 280 and 281 in FIG. 9, for counterbalancing the axial component of the force developed in the discharge zone of the device 250, which tends to separate the end plates 272 and 273 from the side faces of the gears 62 and 63. The thrust means 280 and 281 are identical. Consequently, only the thrust means 280 will be described in detail hereinafter.

As will be apparent from FIGS. 9 and 10, the thrust means 280 comprises a generally oval-shaped plate 282 having the same shape in plan as the end plate 272 and having a bore 83 in the lower portion thereof to accommodate a shaft extension (not shown) for driving the device 250. In this regard, the structure in the lower portion of the thrust means 280 for counterbalancing a portion of the axial component of the force tending to separate the end plates 272 and 273 from the side faces of the gears 62 and 63 is substantially the same as that in the lower portion of the thrust means 80 of the device 50. Accordingly, this description will not be repeated and reference should be made in this specification to the description of the annular recess 93, annular thrust member or piston 94, location and mounting of the compression springs 106 and 107, and axial pressure loading chamber 116, for an understanding of the function and operation of this structure in the thrust means 280.

As in the device 50, the thrust means 280 includes another thrust member or piston 294 for counterbalancing another portion of the axial component of the force tending to separate the end plates 272 and 273 from the side faces of the gears 62 and 63. The thrust member 294 is annular and another annular recess 293 is provided in the inner side 84 of the thrust plate 282 for receiving the annular thrust member 294. The thrust member 294 closely fits and is shiftably mounted in the recess 293, the centers of the recess 293 and thrust member 294 being generally coaxial with that of the gear shaft 66. The inside and outside diameters of the thrust member 294 are such that a substantial portion of the inner end face, indicated at 296, of the thrust member 294 overlaps and engages a portion of the outer side 88 of the end plate 272 surrounding the shaft bore 76. An O-ring 297 is seated in an annular groove in the radially outer edge of the thrust member 294 and an O-ring 298 is seated in another groove in the radially inner side wall of the annular recess 293. The O-rings 297 and 298 prevent leakage and pressure loss between the radially inner and outer edges of the thrust member 294 and the radially inner and outer peripheral walls of the recess 293.

Spring means in the form of a pair of compression coil springs 302 and 303 are seated in two pairs of aligned, axial bores 304 and 305 in the bottom of the recess 293 and opposed surface of the thrust member 294, respectively. The springs 302 and 303 thus coact with the springs 106 and 107 to maintain a minimum static clearance between the side faces of the gears 62 and 63 and the end plate 272. The springs 106, 107, 302 and 303 also accommodate thermal expansion of the operating parts of the internal unit assembly 251.

When mounted in its recess 293, another annular, axial, pressure loading chamber 316 is defined by the space in the recess behind the piston 294, which is adapted to receive fluid under pressure from the annular pressure loading chamber 116 through a pair of intersecting bores 126 and 127 in the thrust plate 282. Fluid under pressure from the high pressure zone of the device 250 is communicated to the pressure loading chambers 116 and 316 through an axial bore 122 in the end plate 272 and thence to the inner end of a diagonally extending passage 123. The outer end of the passage 123 registers with an axial bore 124 in the bottom of the spring bore 109 in the thrust plate member 94. Consequently, when the device 250 is in operation and high pressure is present in the discharge zone of the pump, such pressure is also present in the axial pressure loading chambers 116 and 316. The axial component of the force tending to separate the end plate 272 from the side faces of the gears 62 and 63 is thus counterbalanced so that a substantially zero clearance relationship exists between the side faces of the gears and the end plate 272 throughout the operating speed and pressure range of the pump.

The pressure loading chambers 116 and 316 in the thrust plate 282 of the thrust means 281 likewise serve to maintain a substantially zero, static, axial clearance between the end plate 273 and the side faces of the gears 62 and 63 throughout the operating speed and pressure range of the pump. Since separate axial pressure loading chambers are provided in the thrust plates 282 of the thrust means 280 and 281, the force tending to hold the end plates 272 and 273 in a substantially zero clearance relation with the side faces of the gears 62 and 63 is doubled. Consequently, the fluid displacement displacement device 250 is capable of operating at output pressures substantially twice as high as those developed by the fluid displacement device 50.

The components of the internal unit assembly 251 are maintained in assembled relation by a single tension member in the form of a high tensile strength steel bolt 322, which extends through the hollow interior of the gear shaft 66 and aligned bores 323 and 324 in the thrust plates 282 and 283, respectively. The axes of the bores 323 and 324 are substantially coincident with the axes of the thrust plate members 294 and gear shaft 66. The bolt 322 has an enlarged disk-like head 326 which engages a substantial area of the outer surface of the thrust plate 282. A disk-like nut 327 is threaded onto the opposite end of the bolt 322 and likewise engages a large portion of the outer surface of the thrust plate 283. At least two diametrically spaced, axially extending drive bores 328 and 329 are provided in the nut 327.

The internal unit assembly 251 of the fluid displacement device 250 includes radial pressure balancing means for counterbalancing the radial component of the force generated by high pressure in the discharge zone of the device which tends to shift the internal unit assembly 251 toward the inlet port when the device is in operation. Such radial pressure balancing means is the same as that employed in the device 50. Consequently, like reference numerals have been used to identify the components of the radial pressure balancing means employed in the internal unit assembly 251. Reference should be made in this specification to the description of the radial pressure balancing means of the device 50 i.e. the resilient boots 166, 167, 168 and 169, which define chambers 176, 177, 178 and 179 that are connected to the high pressure zone 79 of the pump, for an understanding of the radial pressure balancing means employed in the device 250.

The fluid displacement device 250 includes releasable retaining means for axially locating the internal unit assembly in the cavity 255 of the housing section 253 so that the gears 62 and 63 are in radial alignment with the inlet and outlet ports (not shown) in the housing section 253. Such releasable retaining means also coacts with the thrust means 280 and 281 to transmit stresses to the housing section 253 in excess of those resisted by elongation of the tension member 322. The releasable retaining means employed in the device 250 is the same as that employed in the device 50. Accordingly, the same reference numerals have been employed to identify these parts which comprises two pairs of U-shaped high strength spring steel retaining rings 147, 148 and 152, 153 respectively seated in circumferentially extending grooves 154, 155 and 156, 157 in the wall of the cavity 255. The retaining rings 147, 148 and 152, 153 thus serve to axially locate the internal unit assembly 251 in the cavity 255 and to transmit stresses to the central housing section 253 in excess of those which can safely be resisted by the tension member 322. Reference should be made in this specification to the description of the construction and operation of the retaining rings 147, 148, 152 and 153 of the fluid device 50 for an understanding of the construction and operation of the retaining rings 147, 148, 152 and 153 of the device 250.

Since the fluid displacement device 250 is intended to operate at higher pressures than the device 50, the device 250 includes means coacting with the releasable retaining means 147, 148, 152 and 153 for transmitting a portion of the axial component of the force tending to separate the end plates 272 and 273 from the side faces of the gears 62 and 63 to the wall of the cavity 255, in addition to the stress transmitted to the housing section 253 by the retaining rings 147, 148, 152 and 153. Such coacting means preferably comprises a pair of generally oval-shaped locking rings 332 and 333 (FIGS. 9, 14 and 14*a*), each of the rings 332 and 333 being split and having a gap 335 at the upper end thereof and being tapered or wedge-shaped in cross section. The radially outer peripheral surface, indicated at 334, of each ring is of substantially the same contour as the surface of the cavity 255 and the inner peripheral surface, indicated at 336, of each ring 332 and 333 is inclined or beveled so that the surface 336 reduces in thickness from the axially outer end, indicated at 337, of the ring toward the axially inner end, indicated at 338. The inclined relationship of the inner peripheral surface 336 of the ring 332 with respect to the outer peripheral surface 334 is best seen in FIG. 14*a*.

A portion 339 of the outer periphery of each of the thrust plates 282 and 283 is chamfered to the same angle as the angle of taper of the inner surface 336 of the locking rings 332 and 333. Consequently, when the inner surfaces 336 of the rings 332 and 333 are engaged with the chamfered surfaces 337 of the thrust plates 282 and 283, the outer peripheral surfaces 334 of the rings will engage the walls of the cavity 255 in surface-to-surface relation, as shown in FIG. 9. In addition, when the aforementioned surfaces on the rings 332 and 333 are engaged with the chamfered surfaces 339 on the thrust plates and with the walls of the cavity 255, the thrust plates 282 and 283 become locked against radial movement in the housing section 253. To this end, the outer peripheral surface 334 of the rings 332 and 333 may be roughened, as by knurling or serrations (not shown), to improve the resistance of the rings to axial shifting in the cavity 255.

The thickness of the rings 332 and 333 is such that a predetermined axial clearance will exist between the axially outer end faces 337 of the rings 332 and 333 and the adjacent side faces of the retaining rings 147, 148, 152 and 153. However, when the pump 250 is operating at its rated output pressure, this clearance is taken up and a reaction force tending to resist separation of the thrust plates 282 and 283 is applied to these plates by the wedging action of the rings 332 and 333 in the cavity 255 of the housing section 253 as well as by the retaining rings 147, 148, 152 and 153. The approximate distribution of the reaction force on the thrust plates from the tension member 322, rings 332 and 333, and retaining rings 147, 148, 152 and 153 will be described in connection with the description of the operation of the device 250.

Assembly and Operation of the Fluid Displacement Device 250

The components of the internal unit assembly 251 of the fluid displacement device or pump 250 are assembled in substantially the same manner as the components of the device 50 i.e. the shafts 64 and 66 of the gears 62 and 63 are inserted in their respective bores 77 and 76 in the end plates 272 and 273 with the teeth of the gears 62 and 63 in mesh. Thereafter, the annular thrust members 94 and 294 are mounted in their respective recesses 93 and 293 in the thrust plates 282 and 283 and the thrust plates are then moved into position opposite the outer sides 88 of the end plates 272 and 273. The tension member 322 is then inserted through the bores 323 and 324 in the thrust plates 282 and 283 and the nut 327 is threaded onto the end of the tension member 322 until a predetermined compression pre-load is placed on the thrust plates 282 and 283. The internal unit assembly 251 is then ready for installation in the central section 253 of the housing, as a unit.

Prior to installing the internal unit assembly 2551 in the cavity 255, screws, similar to the screws 196 and 197 employed in the displacement device 50, are unthreaded from the housing section 253 to relieve pressure on springs, similar to the springs 202 and 203 of the device 50, so that plungers, similar to the plungers 192 and 193 of the device 50, can be retracted into their bores to permit the internal unit assembly 251 to be shifted past the plungers.

After the internal unit assembly 251 is properly positioned in the cavity 255, the screws are again threaded into their respective bores so that the end plates 272 and 273 and gears 62 and 63 of the internal unit assembly 251 are biased toward the outlet port of the housing section 253 to establish a substantially zero, radial static clearance between the lateral side faces of the end plates 272 and 273 of the internal unit assembly 251 and the side wall of the cavity 255 of the housing section 253, in the same manner as in the device 50.

After the internal unit assembly 251 is properly positioned in the housing section 253, the split locking rings 332 and 333 are moved into engagement with the thrust plates 282 and 283 until the tapered inner surfaces 336 of the rings engage the chamfered surfaces 339 on the thrust plates. At this time, the outer surfaces 334 of the rings will be in surface-to-surface engagement with the wall of the cavity 255 of the housing section 253. When engaged with the thrust plates 282 and 283, the rings 332 and 333 center the thrust plates 282 and 283 in the cavity 255. Consequently, tightening of the screws which tend to shift the internal unit assembly 251 toward the discharge port in the housing section 253 will not change the position of the thrust plates 282 and 283.

After the rings 332 and 333 have been installed, the retaining rings 147, 148, 152 and 153 are engaged in their respective grooves 154, 155, 156 and 157. At this time, a predetermined axial clearance will exist between the end faces 337 of the rings 332 and 333 and the adjacent inner faces of the retaining rings 147, 148, 152 and 153.

After the device and anti-drive covers are mounted upon the ends of the housing section 253, and the various fittings are threaded into the inlet and outlet ports of the housing, the device 250 is ready for operation.

When the device is operating at rated speed and pressure, a substantially zero or capillary clearance condition is maintained between the side faces of the gears 62 and 63 and end plates 272 and 273 due to pressure in the axial pressure loading chambers 116 and 316. Pressure is communicated to the pressure loading chambers 116 and 316 in each thrust plate through aligned axial bores 122 in each end plate, and through diagonal bores 123 which communicate with the bores 122 and with the bores 124 in the inner ends of the spring receiving bores 109 in each annular piston or thrust member 94. Pressure in the chambers 116 is communicated to the chambers 316 through intersecting bores 126 and 127 in the thrust plates 282 and 283. The inner ends of the axial bores 122 register with the high pressure zone in the device 250 adjacent the discharge port of the housing section 253.

A substantially zero clearance is also maintained between the lateral side faces of the end plates 272 and 273 and the wall of the cavity 255 of the housing section 53 when the device 250 is in operation due to the pressure in the radial pressure balancing chambers 176, 177, 178 and 179. Pressure from the high pressure zone of the device 250 is communicated to the radial pressure balancing chambers 176, 177 through transversely extending passages 182 and 183 (FIGS. 9 and 11), in the end plate 282 and pressure from the high pressure zone is communicated to the radial pressure balancing chambers 178 and 179 in the end plate 273 through transversely extending passages 182 and 183 in the end plate 273. The aforementioned substantially zero clearance relationship between the lateral side faces of the end plates 272 and 273 and the wall of the cavity 255 is maintained throughout the operating pressure range of the device 250 since the pressure in the radial pressure balancing chambers 176, 177, 178 and 179 varies directly with the pressure in the high pressure zone of the pump.

As the pressure in the high pressure zone of the device 250 increases, the force tending to separate the end plates 272 and 273 from the side faces of the gears 62 and 63 likewise increases. Separation of the end plates 272 and 273 is initially resisted by elongation of the tension member 322, which extends through the hollow anti-drive gear shaft 66. As the output pressure of the pump 250 increases and the tension member 322 elongates, the chamfered outer surfaces 339 of the thrust plates 282 and 283 coact with the tapered inner surfaces 336 of the rings 332 and 333 and cause the latter to wedge against the wall of the cavity 255. Consequently, a portion of the force tending to separate the end plates 272 and 273 from the side faces of the gears 62 and 63 is transmitted through the locking rings 332 and 333 to the housing section 253.

As the output pressure of the pump 250 reaches its operating level, which is approximately 3000 psi, the end faces 337 of the locking rings 332 and 333 engage the inner side faces of the retaining rings 147, 148, 152 and 153. Consequently, the retaining rings 147, 148, 152 and 153 provide an additional force resisting separation of the end plates 272 and 273 from the side faces of the gears 62 and 63. As a result of the aforementioned force distribution, the device 250 can safely operate at much higher pressures than would be possible if only the tensile strength of the tension member 322 were relied upon to resist both axial components of the force tending to separate the end plates 272 and 273 from the side faces of the gears 62 and 63.

By way of example, if the diameter of the tension member 322 is approximately $\frac{7}{8}$ of one inch, and if the effective axial area on which the pressure acts is approximately 3.115 square inches, when the output pressure of the pump is approximately 3000 psi and when the angle of taper between the surfaces 334 and 336 of the locking rings 332 and 333 is approximately 5°, the tension member 322 will resist approximately 40% of the force tending to separate the end plates 272 and 273, the locking rings 332 and 333 will resist approximately 10% of the force through frictional engagement with the side wall 255 of the housing section 253, and the retaining rings 147, 148, 152 and 153 will resist approximately 50% of the force.

Description of the Embodiment Illustrated in FIGS. 15–20, Inclusive

In FIGS. 15–20, inclusive, another gear-type liquid displacement device or pump comprising another embodiment of the invention, is illustrated and indicated generally at 350. Like reference numerals have been used to identify parts identical, or substantially identical, with those of the previous embodiments.

As will be apparent from FIG. 15, the device 350, which is drawn on a somewhat smaller scale than the previous embodiments, comprises an internal unit assembly, indicated generally at 351, which is mounted in and enclosed by a housing 352. The housing 352 includes a central section 353, a drive end section or cover 354, and an anti-drive end section or cover 256. The drive section 354 is secured to the central section 353 by a plurality of threaded fasteners, indicated at 357 in FIG. 16, and includes a drive shaft 358, which transmits power to the pumping components of the internal unit assembly 351 through an extension 359, in the same manner as the fluid displacement device 50.

The internal unit assembly 351 is mounted in a cavity 355 in the central section 353, the cavity 355 in the present instance, being generally in the shape of a figure "8" having upper and lower lobes defined by intersecting circular bores. The central housing section 353 has bosses (not shown) on the laterally opposite sides thereof and the bosses are provided with threaded bores therethrough (also not shown) for supplying working fluid to and removing working fluid under pressure from the device 350 when the latter is in operation.

The internal unit assembly 351 is similar to the previous embodiments in that it includes a pair of liquid displacement elements or gears 362 and 363 having integral, hollow shafts 364 and 366, respectively. The shafts 364 and 366 respectively extend through bores 268 and 369 in two pairs of end plates 372, 373 and 374, 375 disposed on opposite sides of the gears 362 and 363. The end plates 372 and 374 engage each other along a flat, laterally extending interface 376 (FIG. 15), and the end plates 373 and 375 engage each other along a flat, laterally extending interface 377 (FIGS. 15 and 17) coextensive with the interface 376.

The bores 368 in the end plates 372 and 373 are counterbored as at 378 and the bores 369 in the end plates 374 and 375 are counterbored as at 379, to permit roller bearing assemblies 382 and 383 to be mounted in the counterbores 378 and 379 and rotatably journal the gear shafts 364 and 366. Each of the bearing assemblies 382 and 383 include a plurality of roller bearing elements 386, which are supported in annular cages 387.

As in the previous embodiments, the internal unit assembly 351 includes thrust means for counterbalancing the axial components of the force developed in the discharge zone of the device 350, which tends to separate the pairs of end plates 372, 374 and 373, 375 from predetermined positions in relation to the side faces of the gears 362 and 363. Such thrust means, in the present instance, comprises a pair of thrust plates 392 and 393 having the same external configuration as that of the cavity 355, i.e. that of a figure "8" and a pair of thrust members 394 and 395, each of which is likewise in the shape of a figure "8". The thrust members 394 and 395 are disposed between the side faces of the gears 362 and 363 and the inner end faces, indicated at 396, of the pairs of end plates 372, 374 and 373, 375. The thrust members 394 and 395 are supported by axially inwardly extending tubular portions 399 on the end plate members 372, 373, 374 and 375. The lower portions of the thrust plates 392 and 393 are provided with bores 397 and 398, therethrough, the bore 397 accommodating the drive extension shaft 359.

The upper portion of the thrust plate 392 is provided with a tapered seat 402 to receive the complementally-shaped undersurface of the head, indicated at 403, of a tension member 404 which extends through the hollow interior of the anti-drive gear shaft 366. The opposite end of the tension member 404 is threaded as at 406 and threadably engages an axially inwardly extending threaded boss 407 on the thrust plate 393.

According to the present invention, each of the thrust members 394 and 395 comprises a pair of plates 412 and 413 (FIG. 15), which are in the shape of a figure "8" (FIG. 18), the plates 412 and 413 being separated by and being bonded or otherwise secured at their margins to an elastomeric spacer member 414, which is also in the shape of a figure "8", and to a pair of annular spacer members **415*a* and 415*b* (FIGS. 15 and 18) concentric with the annular portions of the spacer member 414. Spring means in the form of a pair of wave washers 416 and 417 are respectively mounted in the upper and lower cavities 418 and 419 of the thrust members 394 and 395. The wave washers 416 and 417, when unstressed, have a greater axial dimension than that of the interior of the cavities 418 and 419. Consequently, the washers 416 and 417 bias the plate members 412 and 413 apart and coact with the elastomeric spacer members 414, 415*a* and 415*b* to establish and maintain a minimum, static, axial clearance between the side faces of the gears 362 and 363 and thrust members 394 and 395. The washers 416 and 417 also accommodate thermal expansion of the operating parts of the internal unit assembly 351**.

The thrust members 394 and 395 are also adapted to counterbalance the axial components of the force at the discharge side of the device 350 when the latter is in operation so that a substantially zero or capillary clearance is maintained between the side faces of the gears 362 and 363, the thrust members 394 and 395 and the end faces 396 of the pairs of end plates 372, 374 and 373, 375. To this end, a hole 422 (FIG. 18) is formed in the plate member 412 of each of the thrust members 394 and 395, the hole 422 registering with the high pressure zone of the device 350 and being operable to communicate such high pressure to the cavities 418 and 419. Consequently, when the device 350 is in operation, the pressure in the cavities 418 and 419 will vary with the output pressure of the pump so that the thrust members 394 and 395 will expand axially and establish the aforementioned substantially zero or capillary clearance relationship. Such clearance will be maintained throughout the operating speed and pressure range of the pump.

In FIGS. 19 and 20, an alternate construction of the thrust members 394 and 395 is illustrated and indicated generally at 424. The thrust member 424 is similar to the thrust members 394 and 395 in that the thrust member 424 comprises a pair of metal plates 432 and 433, which are in the shape of a figure "8" and which are secured to and held in spaced relation by an elastomeric spacer member 434, also in the shape of a figure "8", and by two annular spacer members **435*a* and 435*b*. The spacer members 434, 435*a* and 435*b* are bonded or otherwise secured to the margins of the plates 432 and 433 and define two, interconnected annular cavities 438 and 439 in the thrust member 424. A hole 442 (FIG. 19) is provided in the plate member 432 and located so as to register with the high pressure zone of the device 350. Consequently, when the device 350 is in operation, the cavities 438 and 439 of the thrust member 424** will be maintained at substantially the same pressure as that of the discharge pressure of the pump.

The thrust member 424 differs from the thrust members 394 and 395 in that instead of having wave washers mounted in the cavities 438 and 439, the thrust member 424 includes at least one and preferably three compression coil springs 443, 444 and 445, which are mounted in axially opposed seats 446, 447 and 448 in the inner surfaces of the plates 432 and 433. The compression spring 443, 444 and 445 serve the same function as the wave washers 416 and 417 of the thrust members 394 and 395, i.e. the springs maintain a minimum, static, axial clearance between the side faces of the gears 362 and 363, thrust members 394 and 395, and the end faces 396 of the end plates 372 and 373. The springs 443, 444 and 445 also accommodate thermal expansion of the operating parts of the internal unit assembly 351.

Since separate cavities or axial pressure loading chambers are provided in the thrust members 394 and 395, and also in the thrust member 424, the force tending to hold the plates 412 of the thrust members 394 and 395, and the plates 432 of a pair of the thrust members 424, engaged with the side faces of the gears 362 and 363 is doubled. Consequently, the device 350 is capable of operating at output pressures similar to that of the device 250, which are approximately twice that developed by the device 50.

The fluid displacement device 350 includes releasable retaining means for axially locating the internal unit assembly in the bore 355 of the housing section 353 and for maintaining the gears in radial alignment with the inlet and outlet ports (not shown) in the housing section. Such releasable retaining means also coacts with the thrust plates 392 and 393 of the thrust means to transmit stresses to the housing section 353 in excess of those resisted by elongation of the tension member 404. The releasable retaining means employed in the device 350 same angle of taper of the inner surfaces 467 of the locking rings 462, 463, 464 and 465. Consequently, when the tapered inner surfaces 467 of the rings 462, 463, 464 and 465 are engaged with the chamfered outer surfaces 468 of the end plate members 372, 373, 374 and 375, the outer peripheral surfaces 466 of the rings will be in surface-to-surface engagement with the walls of the cavity 355, as shown in FIG. 15. The thickness of the locking rings 462, 463, 464 and 465 is such that when the rings are fully engaged with the end plates 372, 373, 374 and 375 and the wall of the cavity 355, and when the thrust plates 392 and 393 are engaged with the axially outer end faces, indicated at 469, of the rings 462, 463, 464 and 465, a predetermined clearance will exist between the outer faces 469 and the retaining rings 447, 448, 452 and and 453. Such clearance is taken up by expansion of the components of the internal unit assembly 351 when the device 350 is operating at rated pressure. Thus, the reaction force tending to resist separation of the thrust members 394 and 395 from the side faces of the gears 362 and 363, as well as separation of the inner faces 396 of the end plates from the thrust members 394 and 395, is derived from the frictional force between the outer surfaces 466 of the rings and the wall of the cavity 355 and also from the shear stresses in the retaining rings 447, 448, 452 and 453. As in the fluid displacement device 250, the outer surfaces 466 of the locking rings 447, 448, 452 and 453 may be roughened, as by knurling or serrating (not shown), to improve the resistance of the rings to axial shifting in the cavity 355.

Since the wedge-shaped locking ring segments 462, 463, 464 and 465 become wedged against the wall of the cavity 355 when the device 350 is operating at rated speed and pressure, the internal unit assembly 351 does not include any radial pressure balancing chambers.

Assembly and Operation of the Fluid Displacement Device 350

The components of the internal unit assembly 351 of ing chambers 418 and 419 in the thrust members 394 and 395. Such pressure is communicated to the chambers 418 and 419 through the hole 422 in the plate 412 of each thrust member 394 and 395, or through the hole 442 in the plate 432 of the thrust members 424, the holes 422 and 442 communicating with the high pressure zone of the device 350.

When operating at rated speed and pressure, the axial components of the force tending to separate the thrust members 394 and 395 from the side faces of the gears 362 and 363 is resisted by the tension member 404, the frictional force between the outer surfaces 466 of the segments 462, 463, 464 and 465 and the wall of the cavity 355, and by the shear stresses in the retaining rings 454, 455, 456 and 457. The aforementioned frictional forces and shear stresses are ultimately transmitted to the material of the central housing section 353. As a result of this force distribution, the displacement device 350 can operate at much higher output pressures than would be possible if only the tensile strength of the tension member 404 were relied upon to resist the axial components of the pressure force tending to separate the thrust members 394 and 395 from the side faces of the gears 362 and 363.

The wave washers 416 and 417 in the thrust members 394 and 395 and the compression springs 443, 444 and 445 in the thrust member 424 also serve to accommodate thermal expansion of the operating components of the internal unit assembly 351.

Description of the Embodiment Illustrated in FIGS. 21 and 22, Inclusive

In FIGS. 21 and 22, another gear-type liquid displacement device or pump, comprising another embodiment of the invention, is illustrated and indicated generally at 550. The device 550 is substantially the same as the device 50 but includes some structural aspects of the internal unit assembly 251. Consequently, like reference numerals have been used to identify parts identical with those of the internal unit assemblies 51 and 251.

As will be apparent from FIG. 21, which has been drawn on a somewhat larger scale than the device 50 illustrated in FIG. 1, the device 550 includes an internal unit assembly, indicated generally at 551, which is mounted in and enclosed by a housing. The housing includes a central section 53, a cover or end section (not shown) similar to the drive end section 54 of the device 50, and an anti-drive cover or end section (also not shown), similar to the anti-drive end section 56 of the device 50. The drive and anti-drive end sections are secured to the central section 53 by threaded fasteners (not shown). One of the covers rotatably supports a drive shaft which extends into and effects rotation of the pumping components of the internal unit assembly 551.

The internal unit assembly 551 is mounted in a cavity or bore 55 in the central section 53 and bosses (not shown) on the laterally opposite sides of the central section 53 and having threaded bores therethrough (also not shown) are provided on the housing section 53 for supplying fluid to and discharging fluid from the housing section 53.

With the exception of the thrust plates 552 and 553 and tension members, indicated at 554 and 555 in FIG.. 22, the remainder of the components of the internal unit assembly 551 are identical with those of the internal unit assembly 51 of the device 50. Accordingly, reference should be made in this specification to the description of the parts of the internal unit assembly 51 for an understanding of the construction and operation of their counterparts in the internal unit assembly 551.

The internal unit assembly 551 differs from the internal unit assembly 50 in that, since the device 550 is intended to operate at higher pressures than the device 50, the device 550 includes means for transmitting a portion of the axial components of the force tending to separate the end plates 72 and 73 from the side faces of the gears 62 and 63 to the wall of the cavity 55, in addition to the stresses transmitted to the housing section 53 by the retaining rings 147, 148, 152 and 153 and their coacting thrust means. Such means comprises a pair of oval-shaped, split, locking rings 332 and 333, such as are employed in the internal unit assembly 251. The rings 332 and 333 are tapered or wedge-shaped in cross section, and each has a gap (not shown) at the upper ends thereof. The radially outer periphery, indicated at 334, of each ring is of the same contour as the cavity 55 and the inner periphery, indicated at 336, of each ring 332 and 333 is inclined or beveled so that the surface 336 reduces in thickness or tapers from the axially outer end of the ring, indicated at 337, toward the axially inner end, indicated at 338.

A portion 339 of the outer periphery of the thrust plates 552 and 553 is chamfered to the same angle as the angle of taper of the inner surface 336 of the rings 332 and 333. Consequently, when the inner surfaces 336 of the rings 332 and 333 are engaged with the chamfered surfaces 337 of the thrust plates 552 and 553, the outer peripheral surfaces 334 of the rings will engage the walls of the cavity 55 in surface-to-surface relation, as shown in FIG. 21. As in the fluid displacement devices 250 and 350, the outer surfaces 334 of the locking rings 332 and 333 may be roughened, as by knurling or serrating (not shown), to improve the resistance of the rings to axial shifting in the cavity 55.

The thickness of the rings 332 and 333 is such as to establish a predetermined clearance between the axially outer end faces 338 of the rings 332 and 333 and the adjacent side faces of the retaining rings 147, 148, 152 and 153 when the internal unit assembly 551 is assembled and the prescribed preload has been applied to the thrust plates 552 and 553 by tightening the nuts 146 of the tension members 554 and 555.

In order to accommodate lateral shifting of the gears 62 and 63 and end plates 72 and 73 in the cavity 55 of the housing section 53 due to high pressure in the discharge zone of the device 550, the bores, indicated at 556 and 557 in the thrust plate 553 are of somewhat greater diameter than the outside diameter of the tension members 554 and 555. The bores in the thrust plate 552 are enlarged in the same manner as the bores 556 and 557 in the thrust plate 553.

Assembly and Operation of the Fluid Displacement Device 550

The components of the internal unit assembly 551 are assembled in substantially the same manner as the components of the internal unit assembly 51 of the fluid displacement device 50. Accordingly, reference should be made in this specification to the description of the assembly of the components of the internal unit assembly 51 for an understanding of the assembly of the components of the internal unit assembly 551.

The device 550 also employs oval-shaped, split, locking rings 332 and 333 for transmitting to the housing section 53 a portion of the axial components of the force tending to separate the end plates 72 and 73 of the assembly 551 from the side faces of the gears 62 and 63. The rings 332 and 333 are mounted in the housing section 53 and engage thrust plates 552 and 553 of the internal unit assembly 551 in the same manner that the locking rings 332 and 333 are mounted in the housing section 253 of the device 250. Accordingly, reference should be made in this specification to the description of the manner of mounting the locking rings 332 and 333 in the housing 251 of the device 250 for an understanding of the mounting of these elements in the housing section 53 of the device 550.

A substantially zero static clearance is maintained between the side faces of the gears 62 and 63 and end plates 72 and 73 when the device 550 is inoperative, due to the pressure of compression springs 102, 103, 106 and 107, which act through the thrust members 87 and 94, the latter being mounted in recesses 87 and 94 in the inner side 84 of the thrust plate 552. The pairs of springs 102, 103 and 106, 107 also serve to accommodate thermal expansion of the operating parts of the internal unit assembly 551. Spring biased plungers (not shown), similar to the plungers 192 and 193 of the device 50, maintain a zero static, radial clearance between the internal unit assembly 551 and the wall of the cavity 55 in the central housing section 53, in the same manner as in the device 50.

When the device 550 is operating at rated speed and pressure, a substantially zero or capillary clearance is maintained between the side faces of the gears 62 and 63 and end plates 72 and 73 due to the pressure in the axial pressure loading chambers 116 and 117, such pressure serving to urge the thrust members or pistons 87 and 94 axially inwardly against the end plate 72 with a force proportionate to the discharge pressure developed by the device 551.

A substantially zero or capillary clearance is also maintained between the lateral side faces of the end plates 72 and 73 and the wall of the cavity 55 of the housing section 53 when the device 550 is in operation due to the presence of discharge pressure in the radial pressure balancing chambers 176, 177 and 178, 179.

Since the fluid displacement device 550 includes oval-shaped locking rings 332 and 333 for transmitting to the housing section 53 portions of the axial components of the force tending to separate the end plates 72 and 73 from the side faces of the gears 62 and 63, the device 550 is capable of operation at substantially higher pressures than the device 50. In other words, the force tending to separate the end plates 72 and 73 from the side faces of the gears 62 and 63 is not only resisted by tensile stresses resulting from elongation of the tension members 554 and 555, but also by frictional forces resulting from frictional engagement of the locking rings 332 and 333 with wall of the cavity 55 and by shear stresses in the retaining rings 147, 148, 152 and 153.

From the foregoing description, it will now be apparent that the internal unit assemblies 51, 251, 351 and 551 of the fluid displacement devices 50, 250, 350 and 550, respectively, may be rapidly and simply mounted in and removed from either open end of the central sections of their respective housings for purposes of inspection, cleaning, repair or replacement.

It should also be apparent that the provision of the resilient retaining rings 147, 148, 152, 153 and 447, 448, 452, 453 in the central sections of the housings of the fluid displacement devices 50, 250, 350 and 550 permits such devices to be operated at substantially higher discharge pressures than would be possible with presently available gear pumps where the axial components of the force tending to separate the end plates from the side faces of the gears is resisted solely by a plurality of through bolts or studs which secure covers to the drive and anti-drive ends of the central housing section.

It should further be apparent that the provision of spring means, such as the compression coil springs 102, 103, 106, 107 and 302, 303, 106, 107, which engage the thrust members or pistons in the devices 50, 250, 550, and the wave washers 416, 417 and compression coil springs 443, 444 and 445 in the thrust members 394,395 and 424, respectively, of the device 350, provide a substantially zero, static axial clearance between the components of the internal unit assemblies of these devices so that pumping efficiency on start-up is immediately obtained. In addition, the springs 102, 103, 106, 107; 302, 303, 106, 107; wave washers 416 and 417 in the thrust members 394 and 395 and springs 443, 444 and 445 in the thrust member 424 accommodate thermal expansion of the operating parts of the internal unit assemblies of the devices 50, 250, 350 and 550 when the latter are in operation. In addition, the springs 106, 107; 302 and 303 permit the thrust plates 282, 283 and 552, 553 of the devices 250 and 550 to be shifted axially inwardly to release the locking rings 332 and 333 after the devices have been in operation. The wave washers 416 and 417 or coil springs 443, 444 and 445 in the thrust members 394, 395 and 424 likewise permit the end plates 372, 373, 374 and 375 of the device 350 to be shifted axially inwardly, after the device 350 has been in operation, so that the arcuate segments 462, 463, 464 and 465 can be disengaged from the wall of the cavity 355.

In all embodiments, aligned bores are provided in the thrust plates of the internal unit assemblies so that the drive gears 62 and 362 can be engaged and driven by splined shafts extending into either end of the central housing sections. This feature permits end-to-end stacking of a plurality of internal unit assemblies in a single, elongated, central housing section.

The provision of the spring biased plungers 192 and 193 in the central housing section 53 of the devices 50, 250 and 550 also establish a substantially zero, radial static clearance between the lateral side faces of the end plates 72 and 73 and 272 and 273 of the internal unit assemblies 51, 251 and 551 and at the walls of their respective cavities, adjacent to the discharge ports 79, so that pumping efficiency is immediately established as soon as torque is applied to the drive gears of these devices.

Throughout the specification, the liquid displacement devices 50, 250, 350 and 550 have been herein described as pumps for delivering liquid under pressure at the outlet ports of their respective central housing sections 53, 253, 353 and 553. The devices 50, 250, 350 and 550 can, however, function as motors if liquid under pressure is supplied to the ports which function as outlet ports when the devices are operating as pumps. Thus, if the fluid device 50, for example, is to operate as a pump, liquid under pressure would be supplied to the port 61 in order to maintain the function of the radial pressure balancing chambers 176, 177, 178 and 179. The direction of rotation of the gears 62 and 63 would, of course, be reversed from that shown in FIG. 2.

If liquid under pressure were supplied to the port 61 of the devices 250 and 550, the latter would operate as motors in the same manner as the device 50.

If the liquid displacement device 350 were operated as a motor, fluid under pressure could be supplied to either the port 60 and 61 since the device 350 does not employ radial pressure balancing chambers.

While certain specific embodiments of the invention have been herein illustrated and described in detail, it will be understood that modifications and variations may be effected without departing from the spirit of the invention and the scope of the appended claims.

I claim:

1. In a liquid displacement device including a housing having a cavity therein and an inlet and outlet communicating with said cavity, said liquid displacement device also including an internal unit assembly mounted in said cavity are removable as a unit therefrom through an end of said cavity, said internal unit assembly including a pair of meshed gears disposed between and rotatably supported by a pair of adjoining end plates, means carried by said internal unit assembly for holding said internal unit assembly in assembled relation, said gears and end plates defining high and low pressure zones in said cavity adjacent to said outlet and inlet, respectively, when said internal unit assembly is mounted in said cavity and said device is in operation, and said internal unit assembly including thrust means engaging at least one of said end plates and operable to provide a force preventing separation of said end plates from predetermined positions with respect to the side faces of said gears when said liquid displacement device is in operation, the improvement of retaining means mounted in said cavity and adapted to be engaged by said thrust means so that said internal unit assembly is retained in a predetermined position in said housing cavity with the inlet and outlet in said housing in substantial alignment with said high and low pressure zones, respectively, said retaining means also being adapted to transmit to said housing a portion of the axial component of the force from said high pressure zone tending to separate said end plates from said predetermined positions when said device is in operation and the pressure in said high pressure zone exceeds a predetermined value.

2. The liquid displacement device of claim 1, in which said retaining means is releasably mounted in said housing.

3. The liquid displacement device of claim 2, in which a circumferentially extending groove is provided in the wall of said cavity adjacent to the axially outer side of said thrust means, and said releasable retaining means comprises at least one resilient ring seated in said groove.

4. The liquid device of claim 3, in which a pair of said rings are seated in said groove.

5. The liquid displacement device of claim 4, in which said rings are generally U-shaped.

6. In a gear-type liquid displacement device including a housing having a cavity therein and at least one open end, said housing also having an inlet and outlet communicating with said cavity, said liquid displacement device also including an internal unit assembly adapted to be mounted in and removed as a unit from said cavity through said open end of said housing, said internal unit assembly including a pair of spaced end plates, a pair of meshed gears disposed between and rotatably supported by said end plates, and at least one tension member extending between said end plates for holding said internal unit assembly in assembled relation, said meshed gears and end plates defining high and low pressure zones in said cavity adjacent to said outlet and inlet, respectively, when said internal unit assembly is mounted in said cavity and said device is in operation, said internal unit assembly also including radial pressure balancing means connected to said high pressure zone and operable to counterbalance the radial component of the force from said high pressure zone tending to shift said internal unit assembly toward said inlet when said device is in operation, the improvement of means carried by said housing for urging said internal unit assembly toward said outlet and establishing a substantially zero, radial static clearance between the lateral side faces of said end plates and the wall of said cavity adjacent to said outlet when said device is inoperative, said last mentioned means comprising at least one plunger mounted in the inner end of a bore in the inlet side of said housing, said plunger bore extending substantially transversely to the axis of said cavity and having a spring mounted therein, said spring engaging said plunger and urging the latter into engagement with one of said end plates, whereby pumping efficiency is established by said last mentioned means on starting of said device and maintained by said radial pressure balancing means as said device becomes operable.

7. The liquid displacement device of claim 6, in which an adjustable abutment is provided in said plunger bore for compressing said spring.

8. The liquid displacement device of claim 7, in which said adjustable abutment comprises a screw threaded into the outer end of said plunger bore.

9. The liquid displacement device of claim 8, in which said plunger is shiftable to a retracted position in its bore when said screw is unthreaded from the outer end of its bore so that said internal unit assembly can be shifted into or out of said housing cavity.

10. The liquid displacement device of claim 9, in which a pair of said transversely extending plunger bores are provided in said housing, plungers are mounted in said bores, each of said plungers engages a respective one of said end plates, and screws are threaded into the outer ends of said bores, each of said plungers being shiftable to a retracted position in its bore when the screw associated therewith is unthreaded from the outer end of its bore so that said internal unit assembly can be shifted into or out of said housing cavity.

11. In a liquid displacement device including a housing having a cavity therein and at least one open end, said housing also having an inlet and an outlet communicating with said cavity, said liquid displacement device also including an internal unit assembly mounted in said cavity and removable as a unit therefrom, said internal unit assembly including a pair of spaced end plates, a pair of meshed gears disposed between and rotatably supported by said end plates, and at least one tension member extending between said end plates and holding the parts of said internal unit assembly in assembled relation, said meshed gears and end plates defining zones of high and low pressure in said cavity adjacent to said outlet and inlet, respectively, when said device is in operation, and said internal unit assembly also including thrust means including at least one thrust plate and one thrust member defining at least one axial pressure loading chamber therebetween, said axial pressure loading chamber being operable when pressurized to cause said thrust member to engage and exert a force on one of said end plates so that both of said end plates are biased into engagement with the side faces of said gears when said fluid displacement device is in operation, the improvement of spring means coacting with said thrust plate and said thrust member to establish a substantially zero, static, axial clearance between said end plates and the side faces of said gears when said device is inoperative, whereby pumping efficiency is established by said spring means on starting of said device and maintained by said axial pressure balancing chamber as said device becomes operable, said spring means also serving to accommodate thermal expansion of the operating parts of said internal unit assembly.

12. The liquid displacement device of claim 11, in which said spring means comprises at least one compression coil spring disposed between said thrust plate and said thrust member.

13. The liquid displacement device of claim 12, in which a plurality of said compression coil springs are disposed between said thrust plate and said thrust member.

14. The liquid displacement device of claim 13, in which said compression coil springs are symmetrically arranged with respect to the axis of rotation of the gear associated with said thrust member.

15. The liquid displacement device of claim 14, in which said thrust plate has a recess in the side thereof adjacent to said end plate, said thrust member is shiftably mounted in said recess, said axial pressure loading chamber is defined by the space in said recess behind said thrust member, and said compression coil springs are disposed in said chamber.

16. The liquid displacement device of claim 5, in which a pair of said recesses are provided in the side of said thrust plate adjacent to said end plate, a pair of said thrust members are shiftably mounted in said recesses so as to define a pair of said axial pressure loading chambers, said recesses and said thrust members being in substantial axial alignment with the respective axes of rotation of said gears, and a plurality of said compression coil springs are disposed in each of said chambers.

17. In a liquid displacement device including a housing having a cavity therein and an inlet and an outlet communicating with said cavity, said liquid displacement device also including an internal unit assembly mounted in said cavity and removable as a unit therefrom through an end of said cavity, said internal unit assembly including a pair of meshed gears disposed between and rotatably supported by a pair of adjoining end plates, said gears and end plates defining high and low pressure zones in said cavity adjacent to said outlet and inlet, respectively, when said internal unit assembly is mounted in said cavity and said device is in operation, said internal unit assembly also including thrust means engaging at least one of said end plates and operable to provide a force preventing separation of said end plates from predetermined positions with respect to the side faces of said gears when said liquid displacement device is in operation, the improvement of retaining means mounted in said cavity and adapted to be engaged by said thrust means so that said internal unit assembly is retained in a predetermined position in said housing cavity with the inlet and outlet in said housing in substantial alignment with said high and low pressure zones, respectively, said retaining means also serving to transmit to said housing a portion of the axial component of the force from said high pressure zone tending to separate said end plates from said predetermined positions, and said internal unit assembly further including at least one tension member extending between said end plates and coacting with said thrust means to resist another portion of the axial component of the force from said high pressure zone tending to separate said end plates from said predetermined positions, said tension member and said retaining means coacting sequentially to resist said axial component of the force from said pressure zone tending to separate said end plates from said predetermined positions.

18. The liquid displacement device of claim 17, in which said retaining means is mounted in said cavity and said tension member is adjusted so as to be effective to provide a reaction force resisting said other portion of the axial component of the force from said high pressure zone tending to separate said end plates from said predetermined positions prior to the time that said retaining means becomes effective to resist said portion of the axial component of said separating force.

* * * * *

UNITED STATES PATENT AND TRADEMARK OFFICE

CERTIFICATE OF CORRECTION

PATENT NO. : 4,358,258

DATED : November 9, 1982

INVENTOR(S) : John L. Nagely

It is certified that error appears in the above-identified patent and that said Letters Patent are hereby corrected as shown below:

Col. 13, lines 2 and 3, "fluid displacement displacement device" should read --fluid displacement device--.

Col. 15, line 8, "2551" should read --251--.

Col. 17, line 16, "256" should read --356--.

Col. 17, line 38, "268" should read --368--.

Col. 19, line 12, "spring" should read --springs--.

Col. 27, line 31, "5" should read --15--.

Signed and Sealed this

*Thirty-first* Day of *July 1984*

[SEAL]

*Attest:*

GERALD J. MOSSINGHOFF

*Attesting Officer*

*Commissioner of Patents and Trademarks*